United States Patent [19]

Oshima et al.

[11] Patent Number: 4,651,660

[45] Date of Patent: Mar. 24, 1987

[54] SEWING MACHINE WITH AN AUTOMATIC THREADER

[75] Inventors: Nobuyasu Oshima; Mikio Sato; Katsuhiro Kitajima; Akifumi Nakashima, all of Nagoya, Japan

[73] Assignee: Brother Kogyo Kabushiki Kaisha, Nagoya, Japan

[21] Appl. No.: 863,177

[22] Filed: May 14, 1986

[30] Foreign Application Priority Data

May 20, 1985 [JP] Japan ..... 60-107802

[51] Int. Cl.[4] ..... D05B 87/02

[52] U.S. Cl. ..... 112/225; 112/241

[58] Field of Search ..... 112/241, 225, 302

[56] References Cited

U.S. PATENT DOCUMENTS

| | | | |
|---|---|---|---|
| 2,910,029 | 10/1959 | Herbst | 112/225 |
| 3,485,194 | 12/1969 | Eguchi | 112/225 |
| 4,185,574 | 1/1980 | Totino et al. | 112/225 |
| 4,300,463 | 11/1981 | Morimoto | 112/225 |

*Primary Examiner*—Werner H. Schroeder
*Assistant Examiner*—Andrew M. Falik
*Attorney, Agent, or Firm*—Koda and Androlia

[57] ABSTRACT

A sewing machine with an automatic threader comprises a threading hook for threading a needle, a thread carrying member for passing a thread through a thread take-up spring, a thread holding device for extending the thread from a thread take-up lever near to the thread eye of the needle so that the threading hook is able to catch the thread, an actuating lever for moving the thread holding device releasably holding the thread near to the needle and making the thread holding device transfer the thread to the threading hook, and an operating member for operating the thread carrying member and the actuating lever. These components of the automatic threader are interlocked with each other so that the thread is extended to the threading hook and is passed through the thread eye of the needle automatically by the single downward stroke of the operating member.

8 Claims, 20 Drawing Figures

SEWING MACHINE WITH AN AUTOMATIC THREADER

BACKGROUND OF THE INVENTION

The present invention relates to a sewing machine equipped with a needle threader having a threading hook which catches a thread led near to the thread eye of a needle and passes the thread through the thread eye and more specifically, it relates to a sewing machine with an automatic threader capable of drawing a thread drawn out from a thread supply and threaded through a thread take-up lever near to the thread eye of the needle simply by pressing an operating member, catching the thread with a threading hook inserted in the thread eye and waiting, and passing the thread through the thread eye with the threading hook.

The sewing operation of a sewing machine requires preparatory work, in which a thread wound on a spool is pulled out, is passed through a thread tension regulator, a thread take-up lever, a take-up spring and other members in a predetermined sequence and via a predetermined path, and is passed through the thread eye of a needle. Every type of sewing machines requires such threading work, not excepting the sewing machine equipped with a needle threader having a so-called threading hook.

A needle threader having a threading hook, suitably employed in recent sewing machines is merely capable of facilitating only the work for passing a thread through the thread eye of a needle and is incapable of omitting or facilitating the above-mentioned preparatory work for passing an upper thread through the thread tension regulator, the thread take-up lever and the take-up spring. Threading a sewing machine via a predetermined threading path is troublesome work even for a person skilled in operating the sewing machine and inexperienced operators are liable to fail to thread the sewing machine correctly. If the sewing machine is threaded incorrectly, the sewing machine is unable to carry out sewing operation even if the thread is passed through the thread eye of the the needle. Accordingly, it is important to thread the sewing machine correctly and reliably.

An automatic threader for a sewing machine invented by the applicant of the present invention is disclosed in Japanese Provisional Patent Publication No. 95095/84. This disclosed invention is capable of threading a thread pulled out from an upper thread supply to a take-up spring and passing the thread through the thread eye of a needle, and hence the invention is worthy of a high evaluation in this regard. This previously proposed automatic threader, however, requires a first operation for extending the thread downward from the thread take-up lever and a second operation for leading the thread near to a threading hook inserted in the thread eye of a needle, which is not desirable from the viewpoint of the facility of operation. Furthermore, the automatic threader has a sophisticated mechanism for extending the thread and is inferior in functional reliability.

SUMMARY OF THE INVENTION

Accordingly, it is an object of the present invention to provide a sewing machine with an automatic threader which may readily extend a thread from the thread take-up lever near to a threading hook inserted in the thread eye of the needle through a single step of manipulation of an operating member, which may control the position of an actuating lever supporting at the free end thereof a thread holding device releasably holding a thread, during the pivotal movement of the actuating lever, thereby simplifying the pivotal mechanism for the actuating lever.

In a sewing machine according to the present invention, the actuating lever is pivoted by moving the operating member in one direction to pivot the thread holding device releasably holding the thread so that the thread is extended near to the thread eye of the needle. During this movement, the pivotal posture of the actuating lever is controlled by a control cam so as to correspond to the position of the operating member, and thereby the thread holding device holding the thread is held in an appropriate position within a predetermined vertical range on both sides of the thread eye of the needle. In this state, the thread held by the thread holding device engages the threading hook inserted in the thread eye of the needle. Then, the thread holding device and the threading hook are moved relative to each other, and thereby the thread is released from the thread holding device and is caught and passed through the thread eye of the needle by the threading hook.

In a sewing machine according to the present invention, the thread is extended to a position near the thread eye of the needle, where the threading hook is able to catch the thread without fail, to facilitate the threading operation, through a single step of operation of the operating member instead of a plurality of steps of operation required for threading in the conventional sewing machine. Since the thread is extended through the pivotal movement of the actuating lever and the pivotal posture of the actuating lever is controlled according to the operating position of the operating member, the actuating lever may be a short lever and hence the actuating lever can be easily disposed in a narrow space within the frame of the sewing machine.

BRIEF DESCRIPTION OF THE DRAWINGS

FIGS. 7, 8*a*, 8*b*, 9, 10 and 11 are schematic representations showing the sequential steps of operation of a thread holding device, a thread carrying member and a threading device upon depression of an operating member, in which FIG. 8*b* is a view taken along the direction of the arrow Z in FIG. 8*a*;

DESCRIPTION OF THE PREFERRED EMBODIMENT

A preferred embodiment of the present invention will be described hereinafter with reference to the accompanying drawings.

(Basic Construction of the Sewing Machine)

Figure 1:
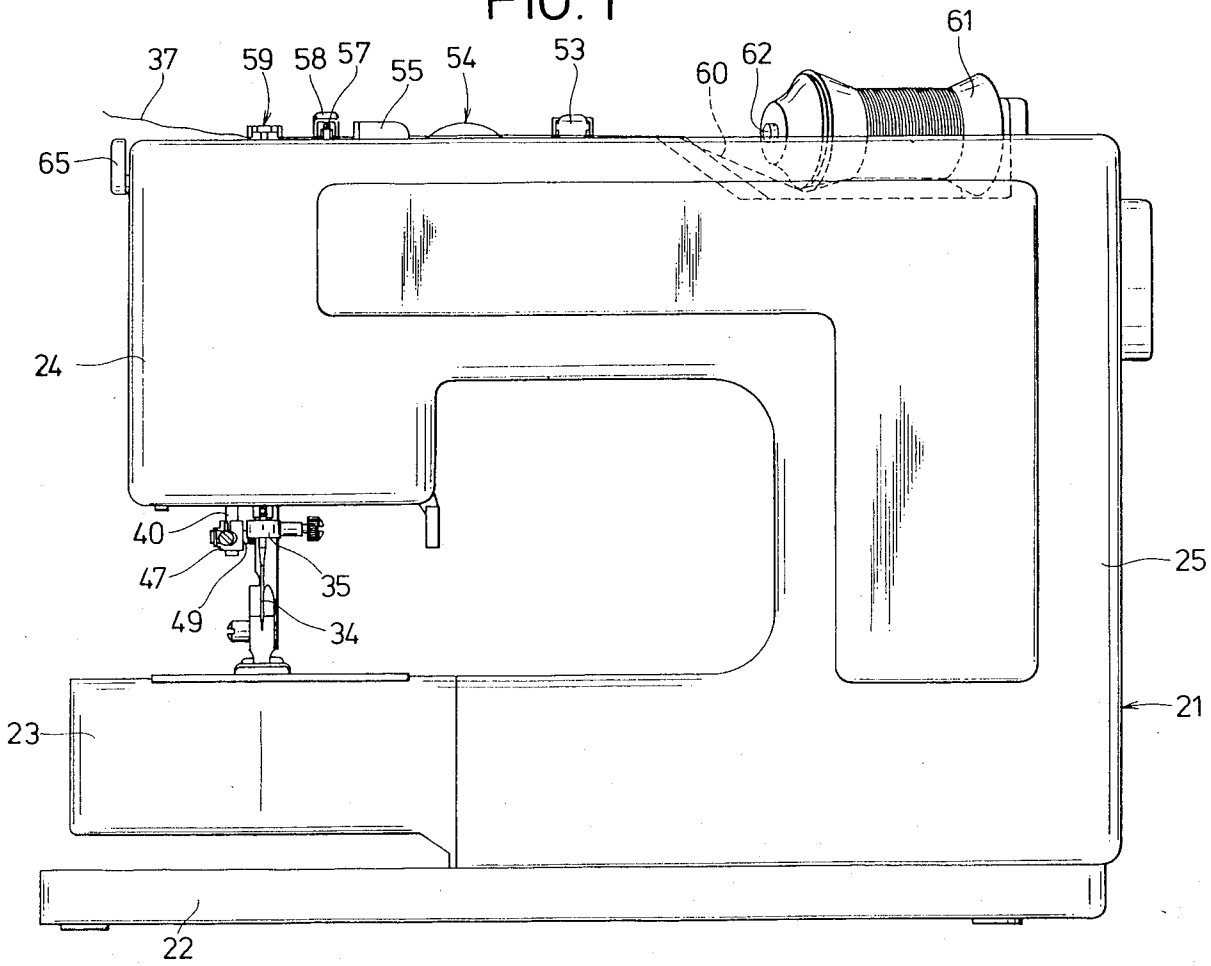
FIG. 1 is a front elevation of a sewing machine with an automatic threader, in a preferred embodiment, according to the present invention, showing the overall appearance and arrangement.
Figure 2:
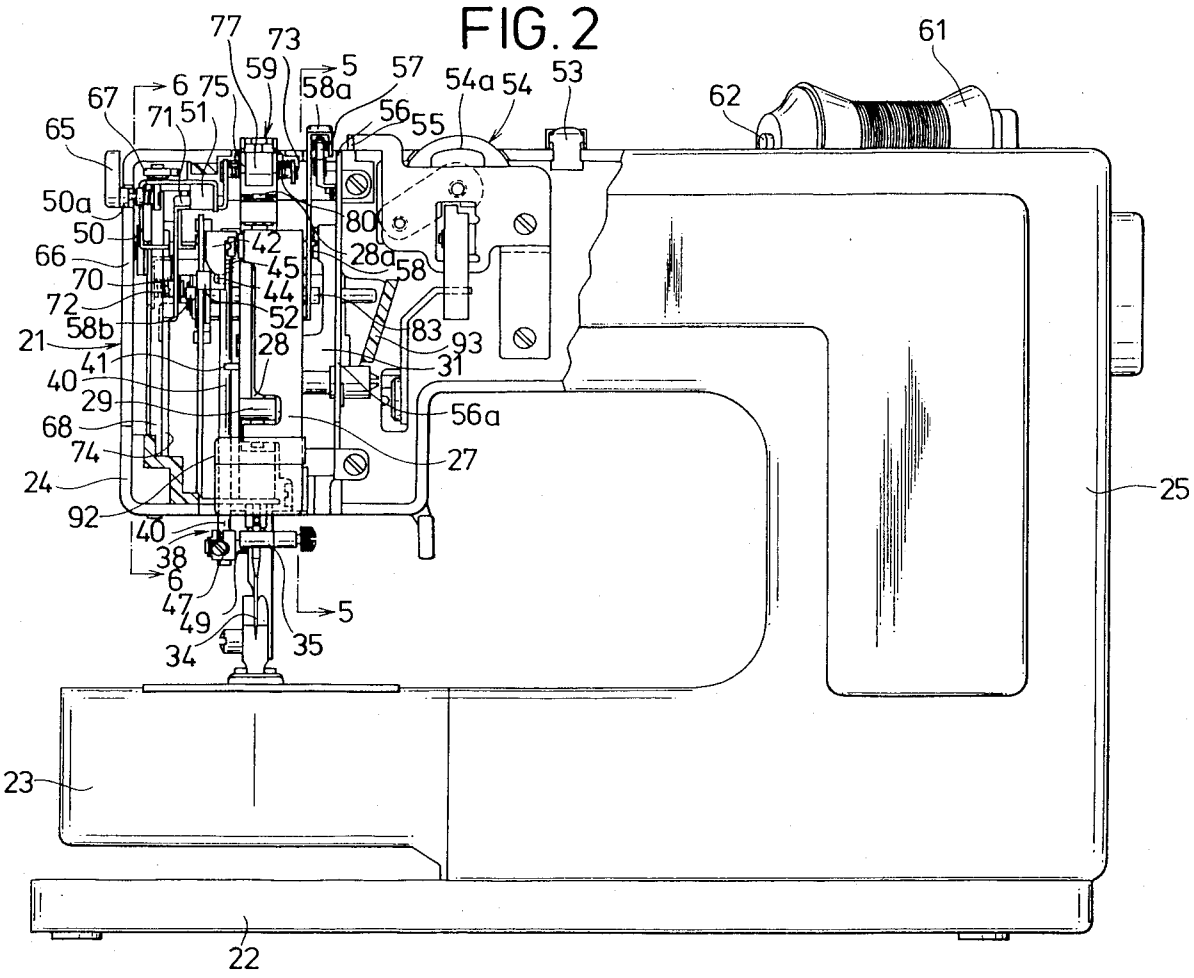
FIG. 2 is a partly cutaway front elevation of the sewing machine of FIG. 1, showing the essential part of the sewing machine.
Figure 5:
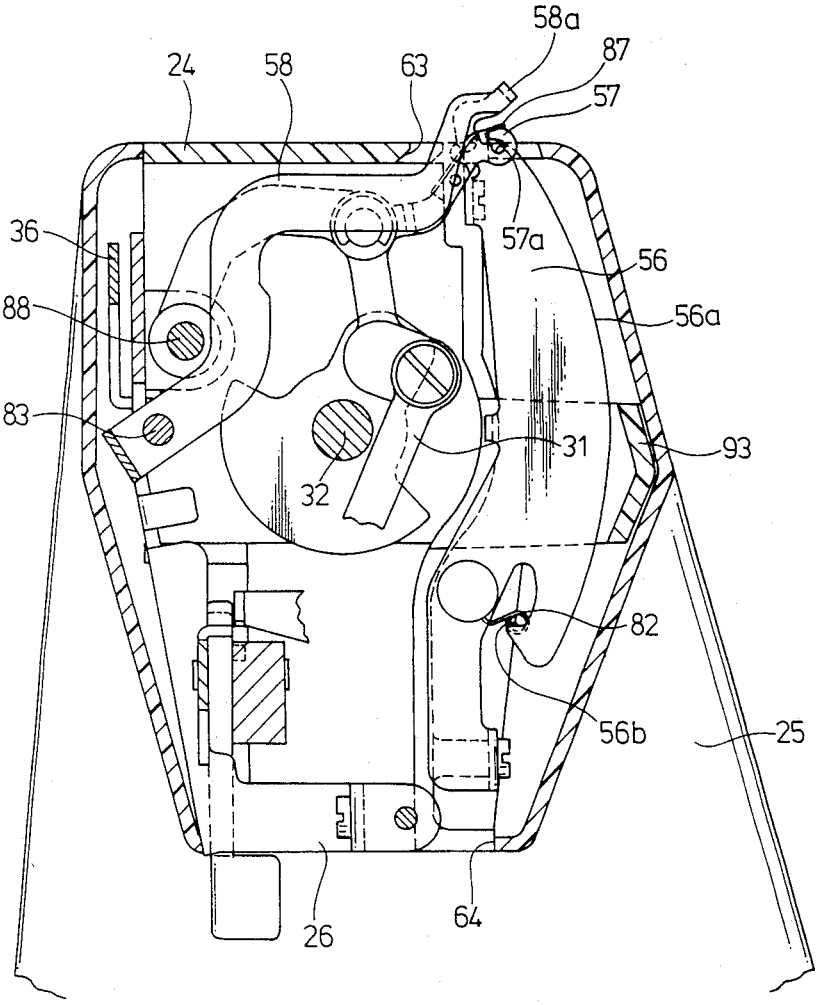
FIG. 5 is a cross section taken on the line 5—5 of FIG. 2.
Figure 6:
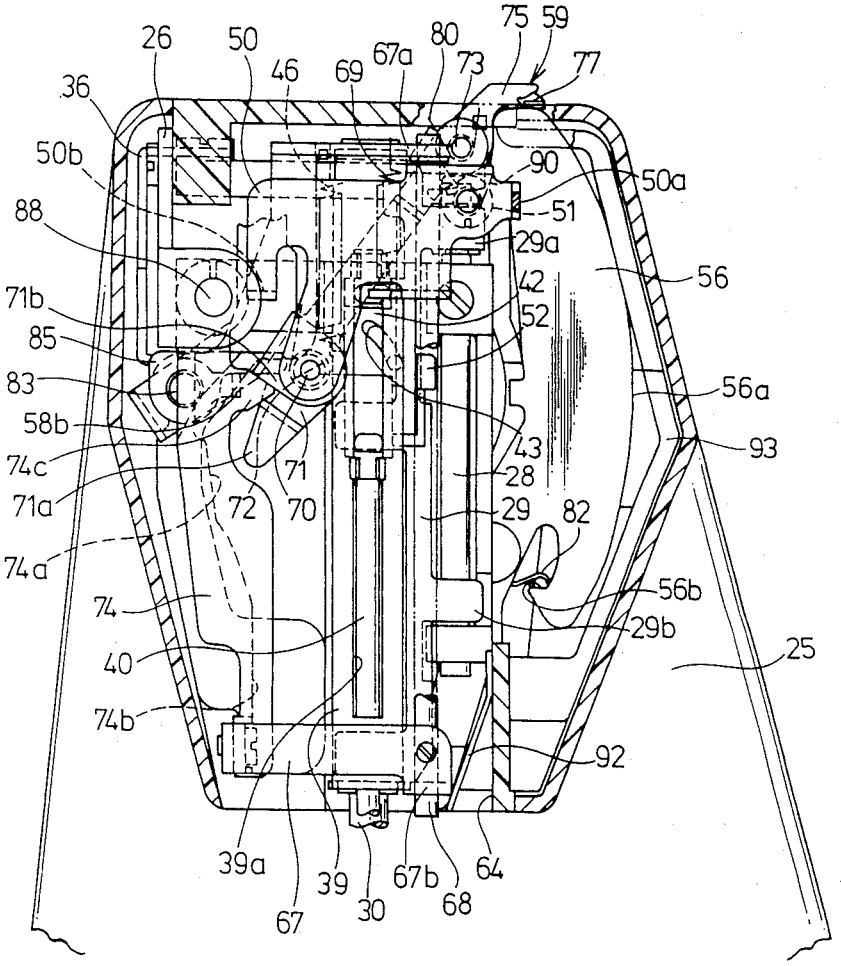
FIG. 6 is a cross section taken on the line 6—6 of FIG. 2.

Referring particularly to FIG. 1, shown therein is a sewing machine in which the present invention is embodied. As shown therein, the sewing machine has a main frame 21 mounted on a base 22. Basically, the main frame 21 comprises a bed 23 horizontally extending above the base 22 and having a sewing surface on the top thereof, an arm 24 extending parallel to and above the bed 23 and having a sewing head on the forward end thereof, and a standard 25 integrally interconnecting the bed 23 and the arm 24. The main frame 21 is of an integral construction formed by injection-molding a hard synthetic resin, imparting light weight to the main frame 21. As illustrated in FIGS. 2 and 5, a support plate 26 formed by bending a steel plate is disposed within the sewing head of the arm 24. The support plate 26 has a needle bar supporting block 27 secured vertically thereto. A needle bar oscillator 29 is supported at its projections 29*a* and 29*b* for horizontal pivotal movement on the needle bar supporting block 27 through a support shaft 28 (FIG. 6). A needle bar 30 is inserted for vertical reciprocative movement through the needle bar oscillator 29. The needle bar 30 is connected to a needle bar connecting link 31 through a needle bar connecting stud (not shown). The needle bar 30 is reciprocated vertically by a main shaft 32 shown in FIG. 5.

A needle 34 having a thread eye 33 is detachably carried at the lower end of the needle bar 30 with a needle clamp 35. A connecting rod 36 (FIGS. 4 and 5) is pivotally connected to the needle bar oscillator 29. The connecting rod 36 is reciprocated horizontally by a pulse motor (not shown), to drive the needle bar 30 for lateral oscillating movement necessary for zigzag stitching.

(Threading Device and Associated Mechanism)

Figure 4:
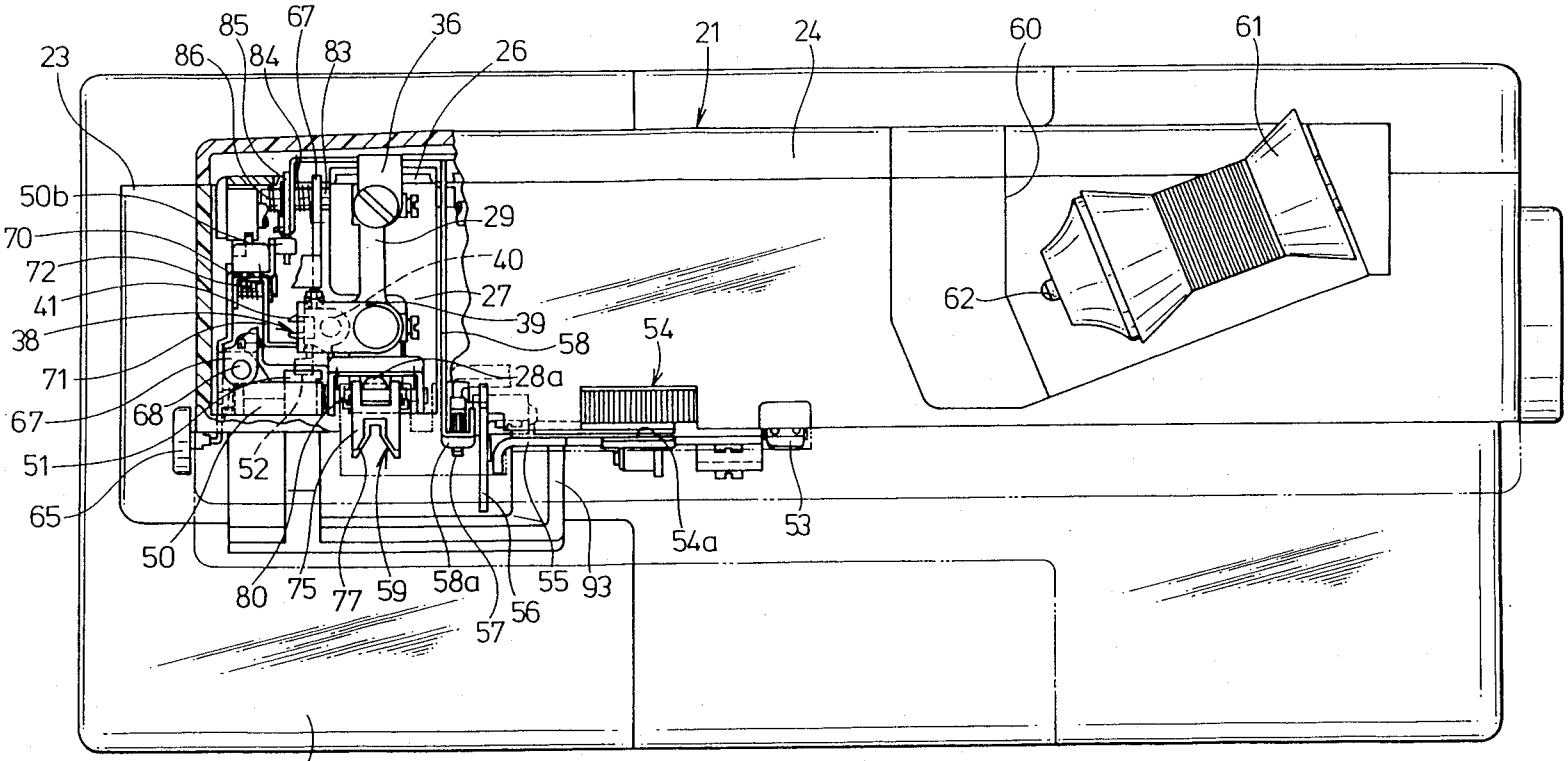
FIG. 4 is a partly cutaway plan view of the sewing machine of FIG. 1.

A threading device 38 is provided on the needle bar oscillator 29 for catching a thread 37 extended near to the thread eye 33 of the needle 34 and passing the same thread 37 through the thread eye 33 with a threading hook 48. Specifically, as shown in FIGS. 2, 4 and 6, a threader guide plate 39 of an elongate U-shaped configuration is disposed parallel to the vertical side surface of the needle bar oscillator 29 and is supported pivotally at the upper and lower ends thereof on the needle bar oscillator 29 so as to be turnable within a predetermined angular range on the needle bar 30. A slot 39*a* having a predetermined width is formed vertically in the threader guide plate 39. A threading bar 40 is received axially movably and rotatably through a horizontal extension extending from the lower end of the threader guide plate 39. The horizontal position of the threading bar 40 relative to the needle bar 30 is decided by a forked member 41 secured to the needle bar 30 and holding the threading bar 40.

Figure 9:
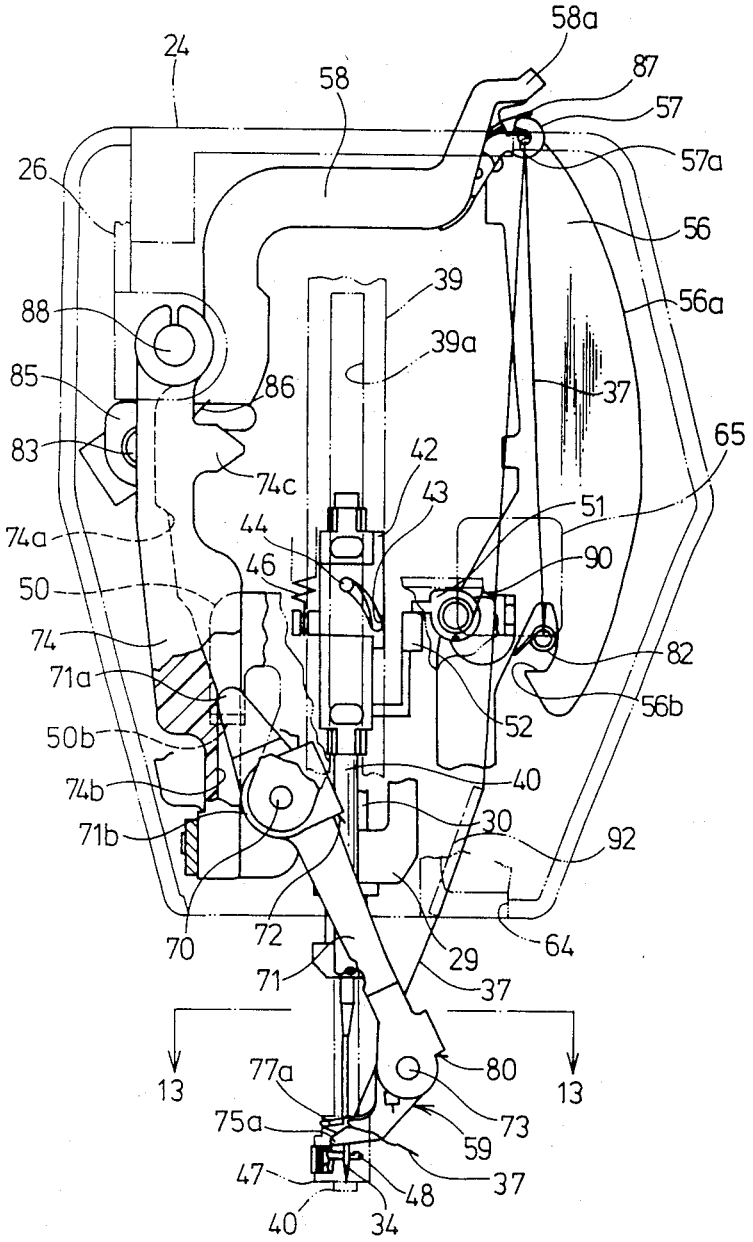

A threading slider 42 made of a resin and having a shape shown in FIG. 9 is fitted vertically slidably in the slot 39*a* of the threader guide plate 39. The upper end of the threading bar 40 is fitted in the upper end of the threading slider 42. A guide pin 44 projecting from the threading bar 40 is fitted in an oblique slot 43 of a predetermined length formed in the threading slider 42. The threading bar 40 is normally urged resiliently downward by a compression spring 45 (FIG. 2). Spring means 46, namely, an extension spring, is extended between the respective projections of the threading slider 42 and the threader guide plate 39 (FIGS. 6 and 7) to urge the threading slider 42 normally upward. An elastic projection 52 projects upward from the side wall of the threading slider 42 so as to be engaged with and disengaged from a finger 51 formed in an actuating member 50 which will be described later.

Figure 13:
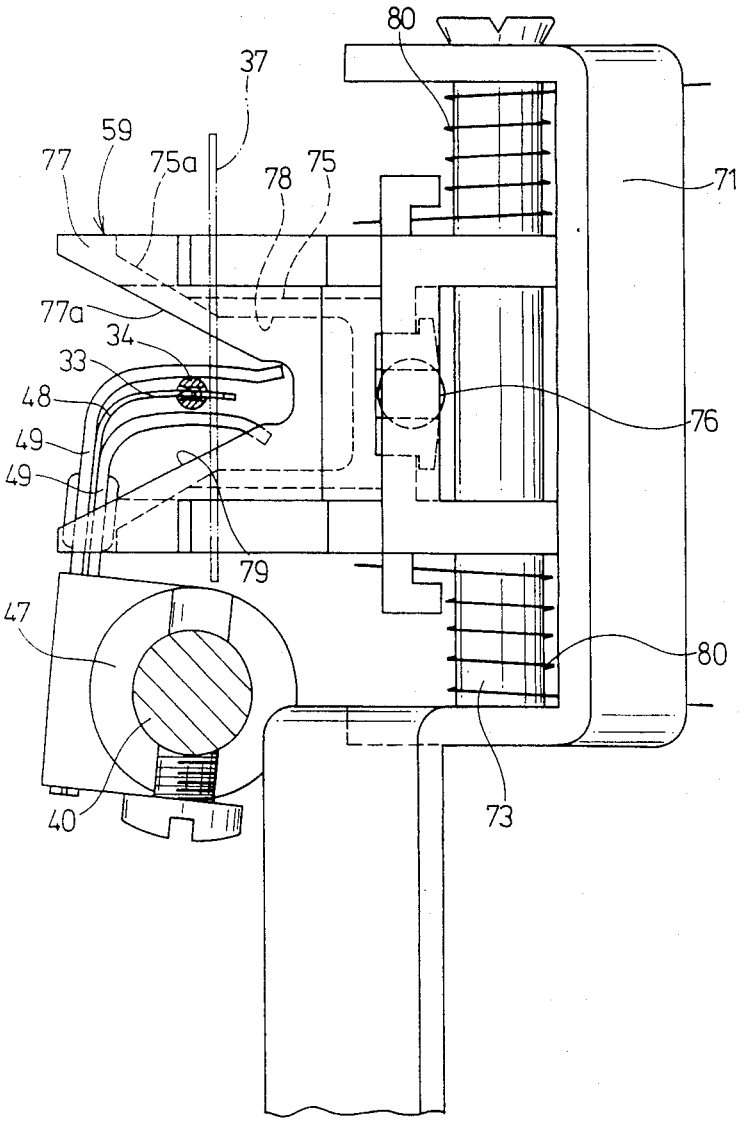
FIG. 13 is a sectional view taken on the line 13—13 of FIG. 9, in which the thread holding device has arrived at a position near the thread eye of the needle and the thread held by the thread holding device is brought into contact with the threading hook inserted in the thread eye of the needle and waiting for threading operation.

As illustrared in FIG. 13, a hook holding collar 47 is provided and is attached to the lower end of the threading bar 40. The hook holding collar 47 has extending therefrom a curved threading hook 48 and a pair of protective fingers 49 disposed on the opposite sides of the threading hook 48, respectively. The threading hook 48 is shorter than the protective fingers 49. When the threading hook 48 is inserted in the thread eye 33 of the needle 34 during the threading operation of the threading device 38, the protective fingers 49 project forwardly of threading hook 48 with the needle 34 located therebetween . The basic arrangement and the manner of operation of the threading device is the same as those of the device disclosed in U.S. Pat. No. 2,910,029.

(Thread Supplying Path)

Figure 3:
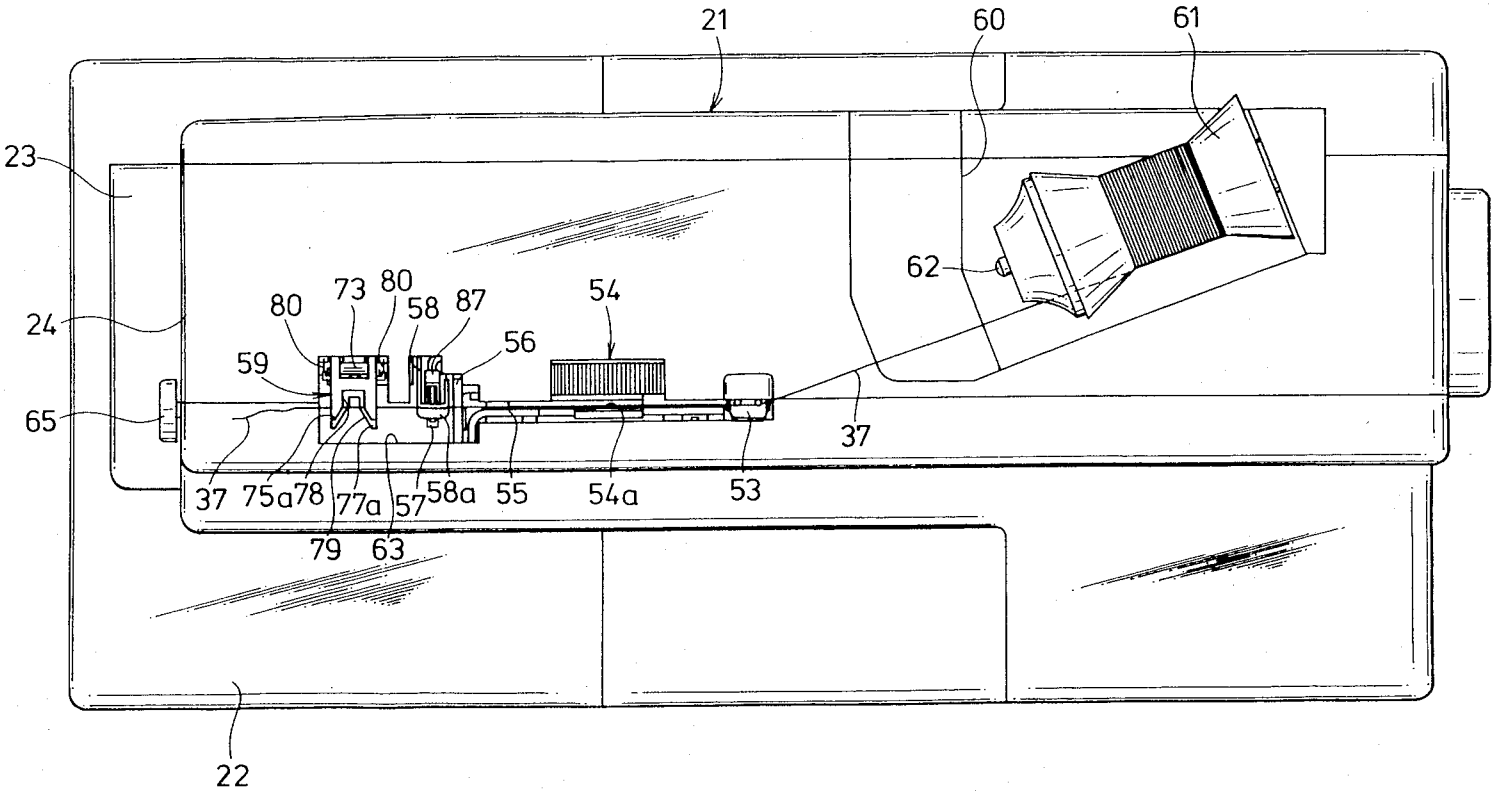
FIG. 3 is a plan view of the sewing machine of FIG. 1.

Referring to FIG. 2, the arm 24 includes several cooperating components by means of which the thread 37 is fed from a thread supply to the needle 34. The cooperating components are a thread guide 53 for smoothly guiding the thread 37 pulled out from a thread supply, a thread tension regulator 54, a guide wall 55, a guide plate 56, a thread take-up lever 57, a thread carrying member 58 and a thread holding device 59 which are arranged on the operator side from right to left. The thread carrying member 58 and the thread holding device 59 will be described later in greater detail. As illustrated in FIG. 3, the thread guide 53, the thread receiving portion 54*a* of the thread tension regulator 54 and the guide wall 55 form a linear thread supply passage extending along the longitudinal direction of the arm 24.

The thread receiving portion 54*a* of the thread tension regulator 54 is aligned with a line passing the thread guide 53 for guiding the thread 37 to the thread tension regulator 54 and the thread carrying portion 58*a* of the thread carrying member 58 waiting at the predetermined position (FIG. 3). The guide wall 55 for guiding the thread 37 into the thread receiving portion 54*a* of the thread tension regulator 54 is formed so that the thread guiding surface thereof is aligned with the linear thread supply passage and extends above the level of the thread receiving portion 54*a*. The left end portion of the guide wall 55 facing the thread carrying portion 58*a* of the thread carrying member 58 is bent along the direction of pivotal movement of the thread carrying member 58.

A recess 60 for receiving the lower half of a spool 61, namely, the thread supply, is formed in the upper wall of the arm 24. A spool pin 62 for supporting the spool 61 is attached to the upper wall of the arm 24 at an angle to the longitudinal axis of the arm 24 so that the spool pin 62 is directed toward the right end of the linear thread supply passage. As shown in FIGS. 3 and 5, a rectangular upper opening 63 is formed in the upper wall of the arm 24 to allow the thread take-up lever 57, the thread carrying member 58 and the thread holding device 59 to project slightly therethrough. As shown in FIGS. 6 and 9, a lower opening 64 is formed in the lower wall of the arm 24 to allow the thread 37 and the thread holding device 59 to pass therethrough. The thread take-up lever 57 reciprocates in a vertical plane along an arcuate path within the arm 24 and hence, unlike the conventional sewing machines, no slot is formed for the thread take-up lever in the front wall of the arm 24. Accordingly, the sewing machine of the present invention has a neat appearance as illustrated in FIG. 1.

Figure 10:
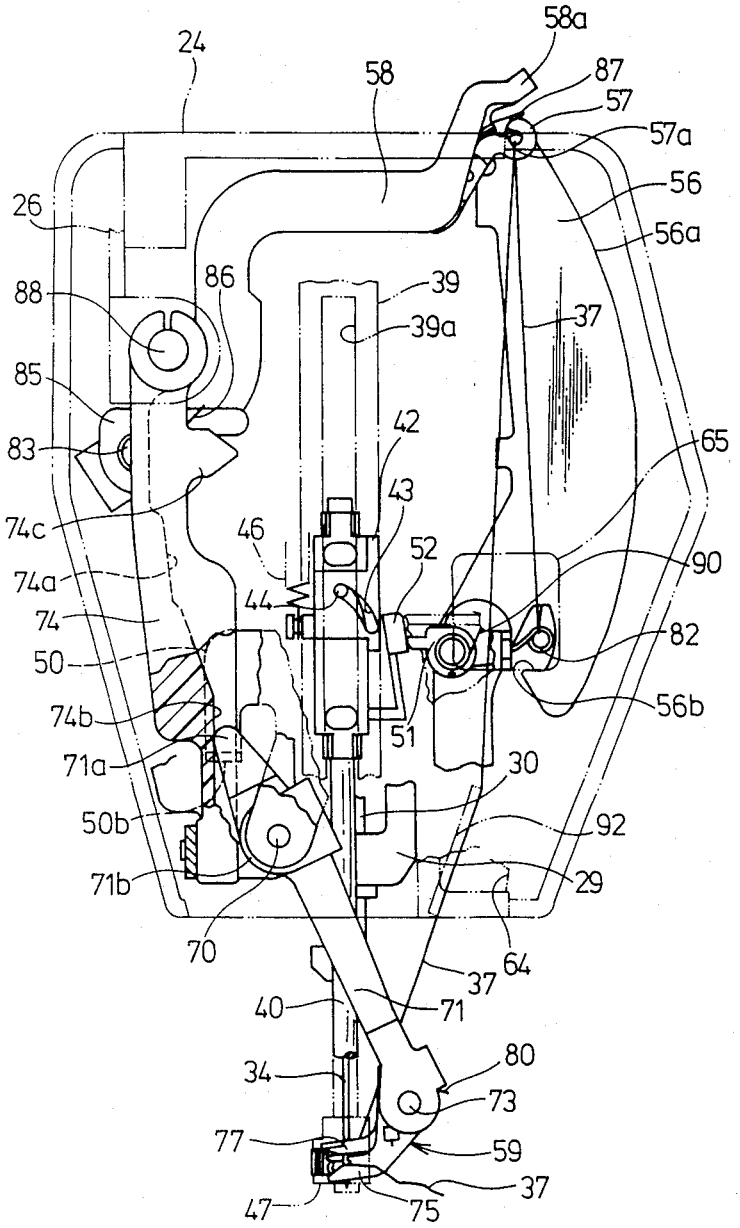
Figure 11:
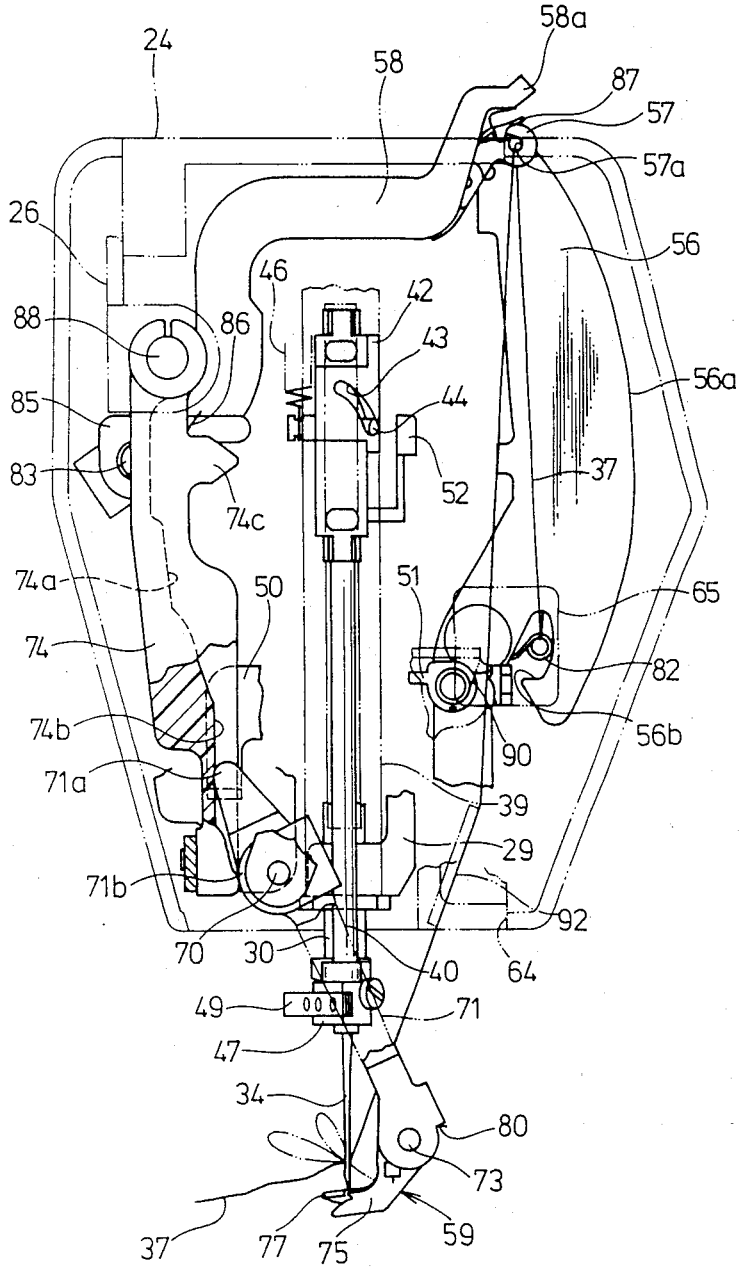

As shown in FIGS. 9, 10 and 11, space demarcating means 91 is provided within the main frame 21 to define a vertical space for the movement of the thread holding device 59 in front of the needle bar 30. The space demarcating means 91 comprises a guard plate 92 having a sufficient width to cover the range of horizontal swing motion of the needle bar 30, disposed in front of the needle bar 30 and fixed to the main frame 21, and a space demarcating frame 93 bulged frontward within the arm 24 as shown in FIG. 4. When the thread holding device 59 is lowered to bring the thread 37 near to the thread eye 33 of the needle 34, the guard plate 92 guides the thread 37 smoothly downward and prevents the thread 37 from being caught by the adjacent parts.

(Thread Holding Device)

As illustrated in FIGS. 2 and 6 to 11, the thread holding device 59 for releasably holding the thread 37 is provided within the arm 24. The thread holding device 59 can be moved by the operating member 65 from its inactive waiting position to its operative threading position near the thread eye 33 of the needle 34. A vertical slot 66 having a predetermined length is formed in the left surface, as viewed in FIG. 2, of the arm 24. The extension 50*a* of the actuator 50, which is formed by bending a plate into a shape shown in FIGS. 2 and 6, projects outside the arm 24 through the slot 66. The operating member 65 having the shape of a cuboidal knob is fixed to the free end of the extension 50*a* of the actuator 50. A support frame 67 having a shape shown in FIG. 6 is provided fixedly within the arm 24. A guide shaft 68 is inserted vertically through and fixed to horizontal projections 67*a* and 67*b* formed at the upper and lower ends of the support frame 67, respectively. The actuator 50 is supported vertically slidably on the guide shaft 68 (FIG. 2). As shown in FIG. 6, an extension spring 69 is provided between the actuator 50 and the support frame 67 to urge the actuator 50 upward so that the operating member 65 is held at the upper end of the slot 66.

Figure 7:
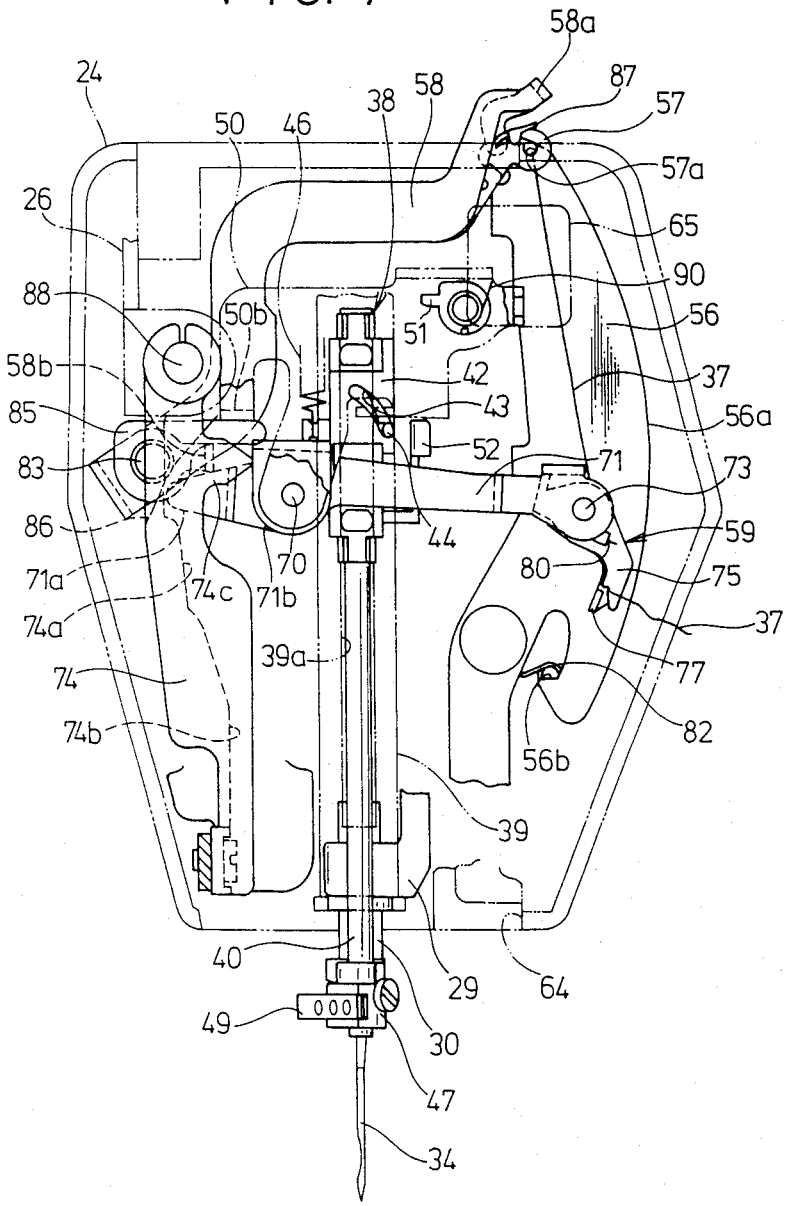

As shown clearly in FIG. 7, an actuating lever 71 is pivotally supported on a fixed shaft 70 secured to the actuator 50 at a position behind the needle bar 30. A torsion coil spring 72 is wound on the fixed shaft 70 as shown in FIG. 2 to urge the actuating lever 71 normally up to a predetermined waiting position shown in FIG. 6. As shown in FIG. 2, the actuating lever 71 is pivotable within a predetermined angular range about the axis of the fixed shaft 70 extending at right angles to the needle bar 30. The actuating lever 71 supports the thread holding device 59 within a plane (FIGS. 9, 10 and 11) containing the needle bar 30.

The thread holding device 59 releasably holding the thread 37 is pivotally connected at the free end of the actuating lever 71 through a pin 73. The thread holding device 59 will be described later in greater detail with reference to FIGS. 13 and 14. The other end 71*a* of the actuating lever 71 extends a predetermined length behind the fixed shaft 70. The size of the actuating lever 71 is decided selectively so that the end 71*a* comes into contact with the cam surface 74*a* indicated by a broken line of a control cam 74 when the actuating lever 71 is inclined at a predetermined angle. The cam 74 extends along the direction of movement of the operating member 65 within the arm 24 so as to control the tilt of the actuating lever 71 responsive to the varying vertical position of the operating member 65. A vertical linear cam surface 74*b* extends below the cam surface 74*a* to hold the actuating lever 71 in a fixed tilt while the thread holding device 59 is located within a predetermined range on the upper and lower sides of the thread eye 33 near the needle 34. As shown in FIG. 6, the control cam 74 has a protuberant cam surface 74*c*. When the actuating lever 71 is biased to the upper position by the torsion coil spring 72, the base end 71*b* of the actuating lever 71 supported on the fixed shaft 70 is in contact with the inclined surface of the protuberant cam surface 74*c*, so that the actuating lever 71 is held stably at the waiting position.

When the operating member 65 secured to the actuator 50 outside the main frame 21 is depressed, the actuator slidably supported on the guide shaft 68 is lowered a predetermined distance against the resilient action of the extension spring 69 together with the actuating lever 71. As shown in FIG. 7, the end 71*a* of the actuating lever 71 moves downward following the cam surface 74*a* of the control cam 74 as the actuating lever 71 is lowered, so that the actuating lever 71 is pivoted clockwise about the fixed shaft 70 relative to the actuator 50 and the operating member 65.

Figure 14A:
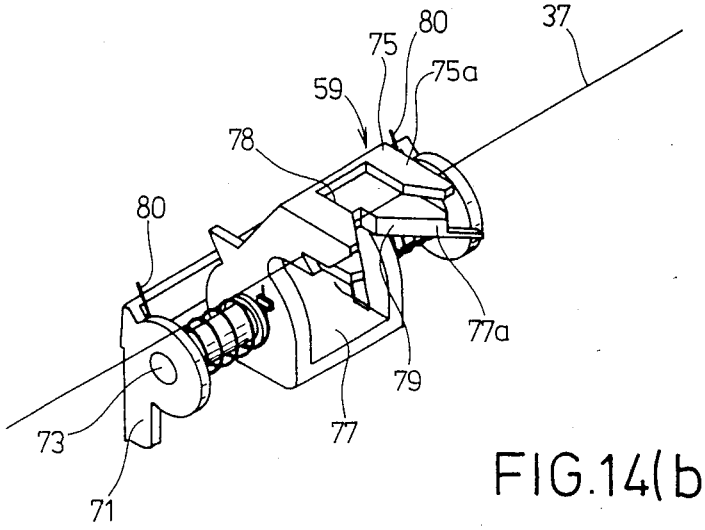
FIGS. 14*a* and 14*b* are perspective views of the thread holding device, showing the genenal construction of the same.
Figure 14B:
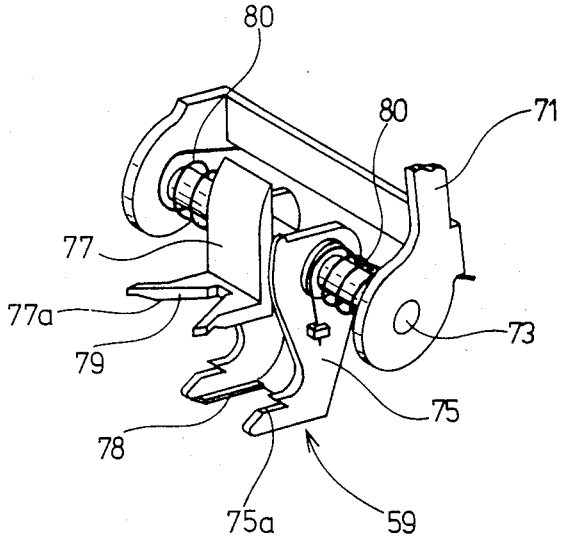

The thread holding device 59 is pivotally supported through a pivot pin 73 on the free end of the actuating lever 71 which is of crooked configuration as shown in FIGS. 13, 14*a* and 14*b*. Basically, the thread holding device 59 comprises a base member 75 having fixed edges 75*a* for holding the thread and pivotally supported on the free end of the actuating lever 71, and a movable member 77 supported for sliding movement relative to the base member 75 and resiliently urged against the fixed edges 75*a* by a compression spring 76 (FIG. 13). The movable member 77 has movable edges 77*a* which engage the fixed edges 75*a* of the base member 75 for holding the thread.

As illustrated in FIG. 13, a first recess 78 is formed between the fixed edges 75*a* of the base member 75 to receive both the threading hook 48 and the protective fingers 49, while a V-shaped second recess 79 of a width narrower than the first recess 78 is formed between the movable edges 77*a* of the movable member 77 to receive only the threading hook 48 therein. The respective sizes of the first recess 78 and the second recess 79 are designed so that the thread 37 is released automatically from the thread holding device 59 when the thread 37 is caught by the threading hook 48 after the thread holding device 59 has arrived at the threading position corresponding to the thread eye 33 of the needle 34.

As shown in FIG. 13, two torsion coil springs 80 are disposed between the opposite sides of the base member 75 and the opposite ends of the pivot pin 73, respectively. Thus, the thread holding device 59 is always resiliently urged on the pivot pin 73 in the direction of swing motion of the needle bar 30 by the torsion coil springs 80 so that the first recess 78 and the second recess 79 thereof are located at a position corresponding to the middle of the range of the horizontal swing motion of the needle bar 30. The thread holding device 59 is pivotally supported on the free end of the actuating lever 71 and is always urged rotatively by the torsion coil springs 80 so that the fixed edges **75*a* and the moveable edges 77*a* are located opposite to the needle 34 when the thread holding device 59 is moved near to the thread eye 33 of the needle 34 as shown in FIG. 9**.

Since the thread holding device 59 and the actuating lever 71 are constructed as described above, when the operating member 65 is depressed manually, the actuator 50 moves downward along the guide shaft 68 and the end **71*a* of the actuating lever 71 along the cam surface 74*a*. Consequently, the actuating lever 71 pivots about the fixed shaft 70 as the actuator 50 is moved downward. As the actuator 50 is lowered further, the thread holding device 59 is moved near to the thread eye 33 of the needle 34 as illustrated in FIG. 9. After the end 71*a* has engaged the linear cam surface 74*b*, the thread holding device 59** moves downward as it is held in its steady pivoted posture.

(Thread Carrying Member)

As shown in FIGS. 2 and 5, a guide plate 56 having an arcuate guide surface **56*a* is provided vertically and fixedly within the main frame 21. The thread carrying member 58 turns in the vicinity of the guide plate 56. Accordingly, the arcuate shape of the guide surface 56*a* coincides with the locus of the thread carrying member 58. A conventional take-up spring 82 is fixed to the guide plate at a position in the lower portion of the right-hand side surface of the guide plate 56**.

Figure 12:
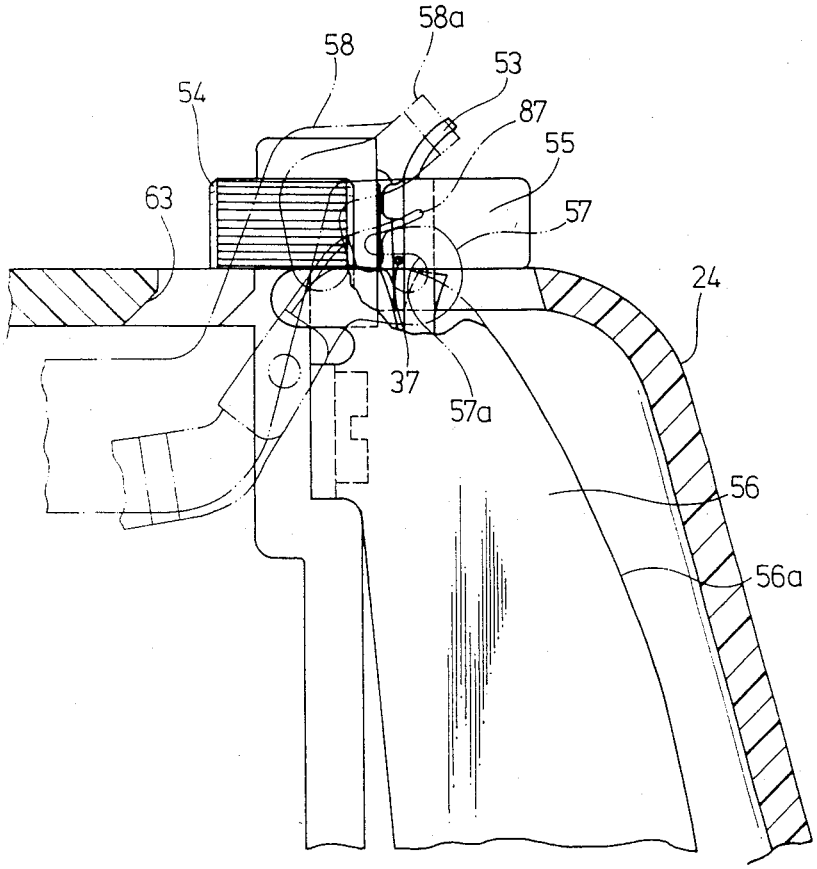
FIG. 12 is an enlarged fragmentary view showing the positional relationship between a thread carrying member at the waiting position and a thread take-up lever.

The thread carrying member 58 is disposed so as to pivot about a fixed shaft 83 provided inside the main frame 21 at an appropriate moment to carry the thread 37 held by the thread take-up lever 57 to the take-up spring 82 provided on the guide plate 56. As shown in FIGS. 7, **8*a* and 8*b*, the thread carrying member 58 is controlled by a first timing control mechanism formed between the thread carrying member 58 and the actuator 50. The thread carrying member is formed in the shape of a lever as shown in FIG. 5 and is pivotally supported on a fixed shaft 83 extending horizontally behind the needle bar supporting block 27 as shown in FIG. 4. The thread carrying member 58 is pivotable between a waiting position shown in FIG. 5 and a lowermost position below the take-up spring 82 shown in FIG. 8*a*. As shown in FIG. 4, a torsion spring 84 is wound on the fixed shaft 83 supporting the thread carrying member 58. The torsion spring 84 has one end connected to the support frame 67 and the other end connected to the base end of the thread carrying member 58. The thread carrying member 58 is normally resiliently urged upward by the torsion spring 84 so that the catching part 58*a* thereof is located at a predetermined waiting position above the uppermost position of the thread take-up lever 57 as shown in FIGS. 5 and 12. As best seen from FIG. 8*a*, the fixed shaft 83 is disposed behind the needle bar 30 within the main frame 21. The thread carrying member 58 extends frontward through a gap between the needle bar oscillator 29 supporting the needle bar 30 and a needle bar connecting link 31 for transmitting the rotary motion of the main shaft 32**.

The catching part **58*a* is formed integrally with the upper free end of the thread carrying member 58. As best seen from FIGS. 2, 3 and 12, the catching part 58*a* is formed by bending the extremity of the thread carrying member 58 in a shape capable of lying between the thread take-up lever 57 and the thread tension regulator 54 beyond the extremity of the thread take-up lever 57 when the thread carrying member 58** is located at the waiting position.

(First Timing Control Mechanism)

Figure 15:
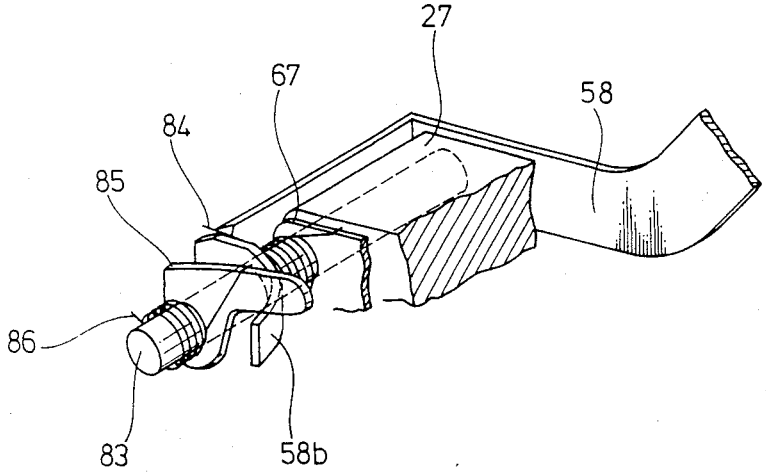
FIG. 15 is a schematic perspective view showing the disposition of a connecting member provided on a fixed shaft supporting the thread carrying member, relative to the thread carrying member.

When the operating member 65 is depressed manually, the thread holding device 59 begins to pivot first, and then, after a predetermined time lag, the thread carrying member 58 is pivoted by means of a first timing control mechanism now to be described. Referring to FIGS. 4, 7, **8*a* and 15, a connecting member 85 is mounted on the fixed shaft 83 pivotally supporting the thread carrying member 58 and is normally resiliently urged downward by a torsion spring 86. As shown in FIG. 15, the base end of the thread carrying member 58 is bent to form a bent portion 58*b* extending below the connecting member 85. The connecting member 85 is urged against the bent portion 58*b*. The actuator 50 is provided integrally with a pressing portion 50*b*, which engages and presses downward the connecting member 85 as the actuator is moved downward. Thus, the first timing control mechanism as described herein comprises the pressing portion 50*b* and the connecting member 85**.

The connecting member 85 of the first timing control mechanism is pivotally supported on the fixed shaft 83 so as to enter or retracts from the vertical passage of the pressing portion **50*b*. At a time when the operating member 65 passes a predetermined operating position as the same is depressed, the pressing member 50*b* of the actuator 50 comes into contact with the connecting member 85 to press the connecting member 85 downward. Consequently, the connecting member 85 pivots together with the thread carrying member 58 until the same is retracted from the passage of the pressing portion 50*b*. The thread carrying member 58 has already returned to the predetermined waiting position before the operating member 65 is moved upward. During the upward travel of the operating member 65, the connecting member 85 is pivoted relative to the thread carrying member 58 by the pressing portion 50*b* to be retracted from the passage of the pressing portion 50*b* as the operating member 65** is moved upward.

Thus, the first timing control mechanism engages the thread carrying member 58, the operating member 65 and the actuator 50 during the travel of the operating member 65 over the entire or part of the operating range from the waiting position to the operating position where the take-up spring 82 is threaded, and disengages the thread carrying member 58 and the operating member 65 as the operating member 65 is moved in a range beyond the operating position.

(Thread Take-up Lever)

As best seen from FIG. 12, the extremity of the thread take-up lever 57 for taking up the thread 37 is crooked to form a guide eye 57*a* and an elastic tongue 87 is provided adjacent to the guide eye 57*a* to prevent the thread 37 slipping off the guide eye 57*a*. As shown in FIG. 5, the thread take-up lever is of the well-known link type. THe thread take-up lever 57 is connected to a link (not shown) pivotally supported on a shaft 88 held on the support plate 26 within the main frame 21 and also to the needle bar connecting link 31 for predetermined reciprocating motion. At the uppermost position, the thread take-up lever 57 project slightly outside the arm 24 through the upper opening 63 of the arm 24.

(Second Timing Control Mechanism for Threading Device)

Figure 8:
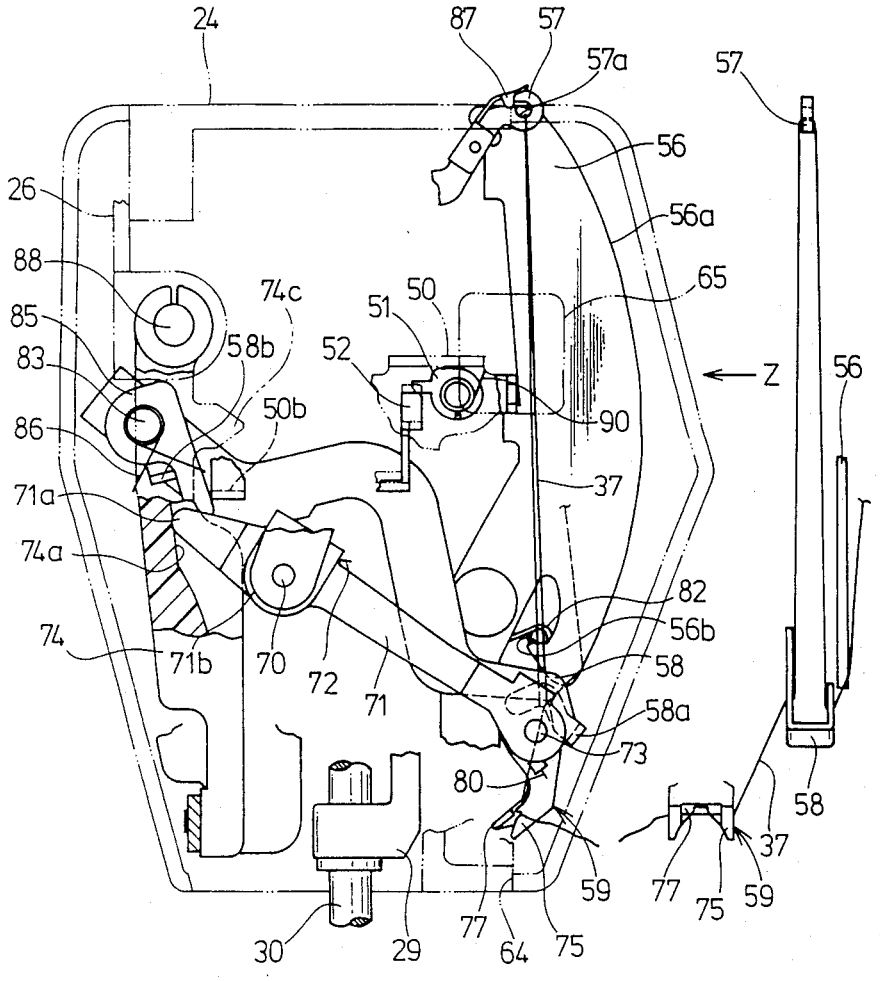

The threading device 38 is provided with a second timing control mechanism which controls the timing of the operation of the threading device 38 in relation to the downward movement of the actuator 50. A finger 51 of a shape shown in FIGS. 2 and 7 is pivotally supported on the actuator 50 and is normally urged clockwise, as viewed in FIG. 7, by a torsion spring 90. An elastic projection 52 projecting from the threading slider 42 is located in a vertical passage along which the finger 51 moves downward together with the actuator 50 when the operating member 65 is depressed. As shown in FIG. 7, the elastic projection 52 is not yet in engagement with the finger 51 at the moment when the thread carrying member 58 begins to pivot under the action of the first timing control mechanism after the operating member has been depressed to pivot the actuating lever 71. As the operating member 65 is moved further downward, the finger 51 engages the elastic projection 52 to press the threading slider 42 downward along the guide plate 39 (FIGS. 8 and 9). When the threading hook 48 is aligned with the thread eye 33 of the needle 34 in the vertical position, the threading hook 48 is turned to be inserted in the thread eye 33 of the needle 34.

Although the operating member 65 is moved further downward after the threading hook 48 has been inserted in the thread eye 33, the elastic projection 52 is bent away from the finger 51 and only the finger 51 is allowed to move downward (FIG. 10). Upon the separation of the elastic projection 52 from the finger 51, the threading slider 42 is raised by the tensile action of the spring means 46, and thereby the threading hook 48 is first retracted from the thread eye 33, and then the same is raised to the original position (FIG. 11). Accordingly, during the upward return movement of the operating member 65 after the completion of a series of sequential actions, the finger 51 engages the elastic projection 52 which has already been returned to the original position. However, since the finger 51 turns slightly counterclockwise against the resilient action of the torsion spring 90 to escape from elastic projection 52, the operating member 65 is allowed to move upward smoothly without any interference.

Thus, the second timing control mechanism comprises the finger 51 of the actuator 50 and the elastic projection 52, and makes the operation of the operating member 65 insert the threading hook 48 in the thread eye 33, interlocks the threading hook 48 and the operating member 65 over the entire or in part of the operating range of the operating member 65 until the operating member 65 is lowered to the predetermined operating position where the thread holding device 59 is brought to a position opposite the thread eye 33, and disengages the threading hook 48 from the operating member 65 upon the further downward movement of the operating member 65 past the predetermined operating position.

(Peripheral Mechanisms)

As shown in FIGS. 4 and 6, the actuating lever 71 holding the thread holding device 59 on the extremity thereof is waiting near the opening 63 formed in the arm 24. When the actuating lever 71 is at the waiting position, the holding portion of the thread holding device 59 is always directed toward the front, namely, toward the operator. That is, at a position near the thread eye 33 of the needle 34, the thread holding device 59 is always pivotally urged by a second torsion spring 80 so that the fixed edges 75*a* and the moveable edges 77*a* are located opposite to the needle 34. However, if the thread holding device 59 is locate at the waiting position in this pivotally urged position, the fixed edges 75*a* and the movable edges 77*a* tilt downward, which makes the threading work of the operator difficult. Accordingly, since the upper end 28*a* of the support shaft 28 supporting the needle bar oscillator 29 for swinging the needle bar 30 is locate near the waiting position of the thread holding device 59 (FIGS. 2 and 4), the thread holding device 59 is seated forcibly on the upper end 28*a* of the support shaft 28 to correct the position of the thread holding device 59 against the biasing action of the torsion spring 80 so that the thread holding device 59 is directed right toward the front of the sewing machine. Thus, the support shaft 28 functions as a member for correcting the position of the thread holding device 59.

The support plate 26 is bolted to the backside of the main frame 21. The needle bar supporting block 27 is secured to the support plate 26, while a needle bar oscillator 29 is supported swingably on the support shaft 28 attached to the needle bar supporting block 27. The assembly of the needle bar supporting block 27 and the needle bar oscillator 29, the actuating lever 71 carrying the thread holding device 59, the thread carrying member 58 and the actuator 50 are assembled in a unit, which is detachably mounted on the arm 24.

(Operational Procedure)

Steps of operation of the sewing machine embodying the present invention will now be described. Before starting a sewing operation, the sewing machine needs to be threaded. As shown in FIGS. 1, 5 and 6, in the waiting state before the sewing machine is threaded, the thread carrying member 58 and the thread holding device 59 are urged to the respective upper positions by the corresponding springs with their upper parts projecting slightly outside the arm 24 through the upper opening 63 of the arm 24. As mentioned above, the thread holding device 59 is seated on the upper end 28*a* of the support shaft 28 with the thread holding edges thereof directed toward the front. As shown in FIG. 12, the thread carrying portion 58*a* of the thread carrying member 58 is located at the predetermined waiting position above the thread take-up lever 57.

Figure 17:
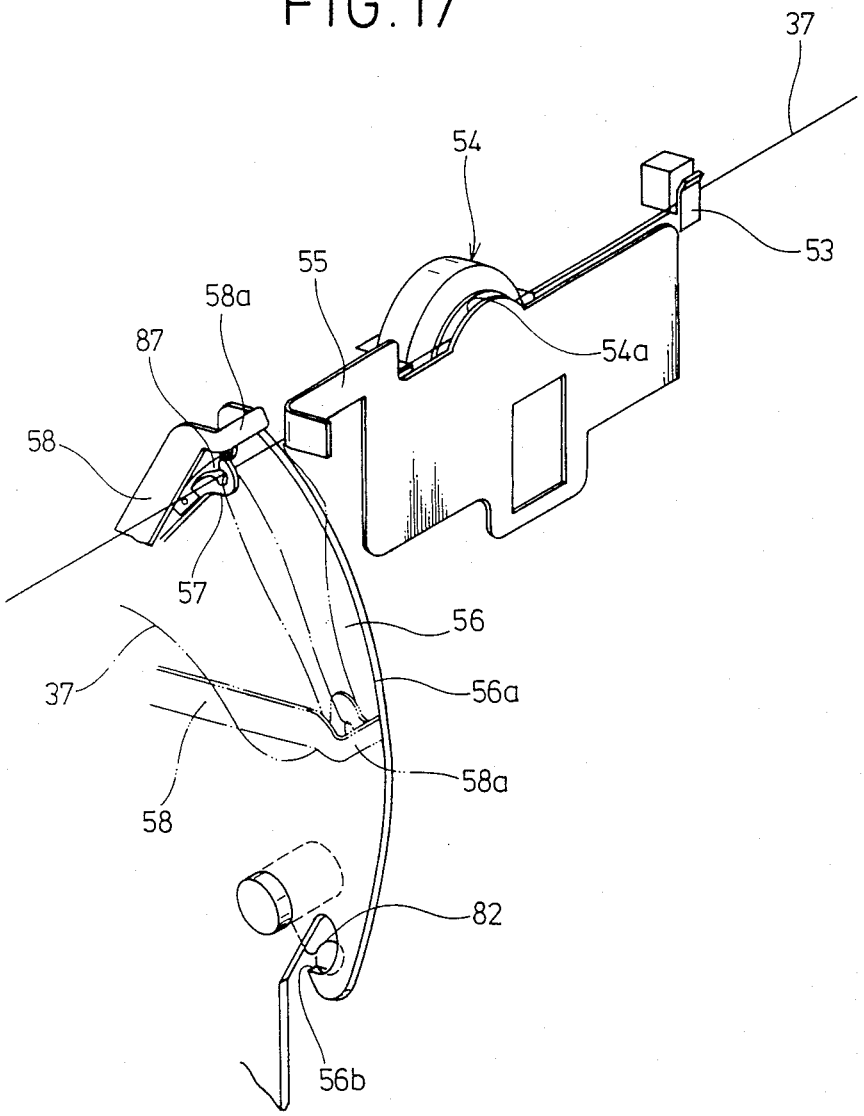
FIG. 17 is a perspective view showing the process of extending the thread along a guide member from the thread take-up lever to the take-up spring by the thread carrying member.

In this state, the thread 37, namely, the upper thread, is pulled out from the spool 61 received in the recess 60, and then the thread 37 is extended through the thread guide 53 and the tension regulator 54 to the thread take-up lever 57. Then, the thread 37 is inserted in the guide eye 57*a* of the thread take-up lever 57 projecting outside through the upper opening 63 by forcibly lifting the elastic tongue 87. Since the guide wall 55 is extended between the thread tension regulator 54 and the thread carrying portion 58*a* of the thread carrying member 58 located at the waiting position along the thread passage extending between the thread guide 53 and the thread carrying portion 58*a* located at the waiting position, the thread 37 falls spontaneously into the thread receiving portion 54*a* of the thread tension regulator 54 when extended between the thread guide 53 and the guide wall 55. After being extended further leftward as shown in FIG. 17, the thread 37 is inserted between the fixed edges 75*a* and the movable edges 77*a* of the thread holding device 59 against the resilient action of the compression spring 76.

After the thread 37 has thus been extended, the operating member 65 located on the left-hand side of the arm 24 is depressed at a stroke, and thereby the take-up spring 82 and the needle 34 are threaded automatically. When the operating member 65 is depressed, the actuator 50 starts moving downward along the guide shaft 68 and the slot 66 formed in the side wall of the arm 24. Then, the actuating lever 71 carrying the thread holding device 59 begins to pivot clockwise about the fixed shaft 70 with the end 71*a* thereof engaging the protuberant cam surface 74*c* of the control cam 74. As the thread holding device 59 is thus moved downward, the thread 37 held between the fixed edges 75*a* and the movable edges 77*a* is extended downward through the guide eye 57*a* of the thread take-up lever 57.

Upon arrival of the actuating lever 71 at a position where the actuating lever 71 assumes a practically horizontal position as illustrated in FIG. 7, the first timing control mechanism begins to function, namely, the pressing portion 50*b* of the actuator 50 engages the connecting member 85 pivotally supported on the fixed shaft 83 which in turn pivotally supports the thread carrying member 58. Consequently, as the actuator 50 is moved further downward, the thread carrying member 58 is pivoted clockwise about the fixed shaft 83 through a large angle through the connecting member 85 by the actuator 50 as illustrated in FIG. 8*a*, and thereby the thread carrying portion 58*a* of the thread carrying member 58 located at the waiting position above the thread take-up lever 57 catches the thread 37 on opposite sides of the guide eye 57*a* of the thread take-up lever 57, and then moves downward along the arcuate guide surface 56*a* of the adjacent guide plate 56 to guide the thread 37 to the take-up spring 82 as illsutrated in FIG. 17. During this thread guiding operation of the thread carrying member 58, the actuating lever 71 carrying the thread holding device 59 is being pivoted under the control of the cam surface 74*a* of the control cam 74 to a position as illustrated in FIG. 8*a*. Upon arrival of the thread carrying member 58 at the lowermost position, the second timing control mechanism for controlling the operation of the threading device 38 begins to function, namely, the finger 51 engages the elastic projection 52.

As the operating member 65 moves further downward, the connecting member 85 is disengaged from the pressing portion 50*b* of the first timing control mechanism as shown in FIG. 9. Consequently, the thread carrying member 58 releases the thread 37 and is returned to the waiting position by the resilient action of the torsion spring 84. Then, the thread 37 enters a recess 56*b* formed in the guide plate 56 at the lower end of the arcuate guide surface 56*a* and is finally caught by the take-up spring 82. On the other hand, the other end 71*a* of the actuating lever 71 moves along the vertivcal linear cam surface 74*b*, and hence the actuating lever 71 is held in a steady pivoted posture thereafter.

While the configuration of the components shown in FIG. 8*a* changes into the configuration shown in FIG. 9, the finger 51 engaging the elastic projection 52 of the second timing control mechanism depresses the threading slider 42 together with the threading bar 40. Upon arrival of the threading hook 48 at the level of the thread eye 33 of the needle 34, the threading hook 48 and the protective fingers 49 are turned in a horizontal plane by the cooperative guiding action of the slot 43 of the threading slider 42 and the guide pin 44 fitted in the slot 43 to insert the threading hook 48 in the thread eye 33 of the needle 34. In this state, the threading hook 48 waits for the threading operation. At this moment, the thread holding device 59 is located near the thread eye 33 and above the threading hook 48 and is held in a steady pivoted posture by the vertical linear cam surface 74*b*.

After the state shown in FIG. 9 has been established, the actuating lever 71 carrying the thread holding device 59 is moved further downward maintaining the same pivoted posture with the other end 71*a* thereof being guided by the vertical linear cam surface 74*b* as the operating member 65 is moved further downward. As shown in FIG. 13, the thread holding device 59 presses the thread 37 extended across the first recess 78 and the second recess 79 thereof against the threading hook 48 inserted through the thread eye 33 of the needle 34. At this moment,the thread holding device 59 is still holding the thread 37 by the action of the compression spring 76.

As illustrated in FIG. 10, the threading slider 42 has already been located at the lower limit position and the elastic projection 52 is bent backward by the finger 51 of the actuator 50. While the state shown in FIG. 10 changes into the state shown in FIG. 11, the elastic projection 52 of the threading slider 42 is released from the finger 51. The threading bar 40 is turned in the reverse direction by the returning action of the compression spring 45 interposed between the threading slider 42 and the threading bar 40 and the guiding action of the slot 43 and the guide pin 44 to retract the threading hook 48 from the thread eye 33 of the needle 34, and thereby the thread 37 is released from the thread holding device 59 and is threaded through the thread eye 33 of the needle 34. Then, the threading bar 40 is raised together with the threading slider 42 by the resilient returning action of the spring means 46 extended between the threading slider 42 and the support frame 67.

As shown in FIG. 11, the thread holding device 59 is moved further downward to the lower limit position as it is held in its pivoted posture by the vertical linear cam surface 74*b*. At a moment when the thread holding device 59 passes by the threading hook 48 inserted in the thread eye 33 of the needle 34, the movable member 77 of the thread holding device 59 engages a part of the threading device 38, for example, the protective fingers 49, so that the movable edges 77*a* is separated from the fixed edges 75*a* of the base member 75 to release the thread 37. More specifically, since the V-shped second recess 79 of the movable member 77 is narrower than the first recess 78 of the base member 75 and is formed so as to receive only the threading hook 48 therein, the movable member 77 of the thread holding device 59 runs against the protective fingers 49 as shown in FIG. 16*a*, and hence the further downward movement of the movable member 77 is prevented. As mentioned above, since the thread holding device 59 is moved further downward as it is held in its pivoted posture by the vertical linear cam surface 74b, the base member 75 is separated inevitably from the movable member 77 to release the thread 37.

Figure 16B:
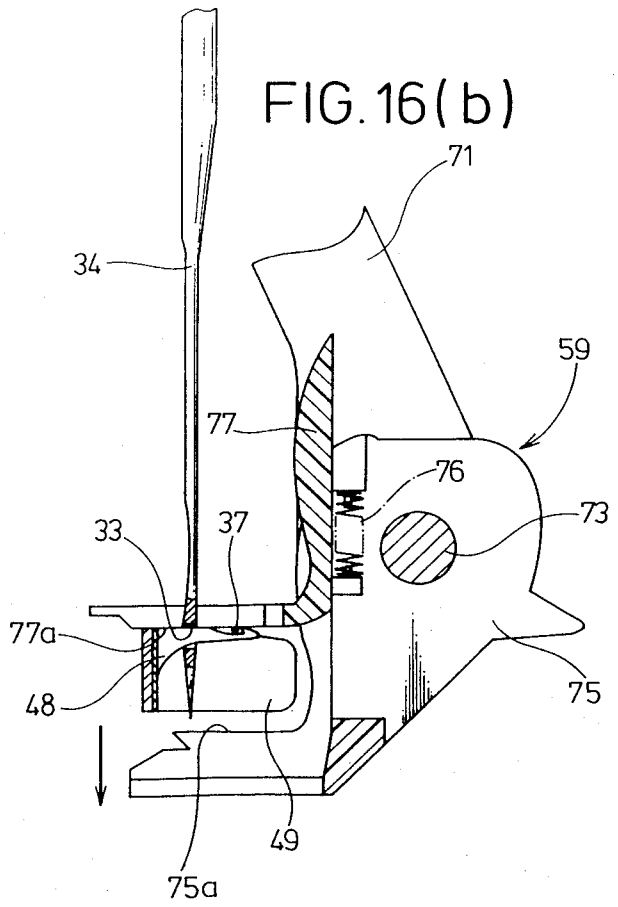
FIGS. 16*a* and 16*b* are schematic illustration of assistance in explaining the sequential steps of operation of the thread holding device for bringing the thread into contact with the threading hook and releasing the thread.
Figure 16A:
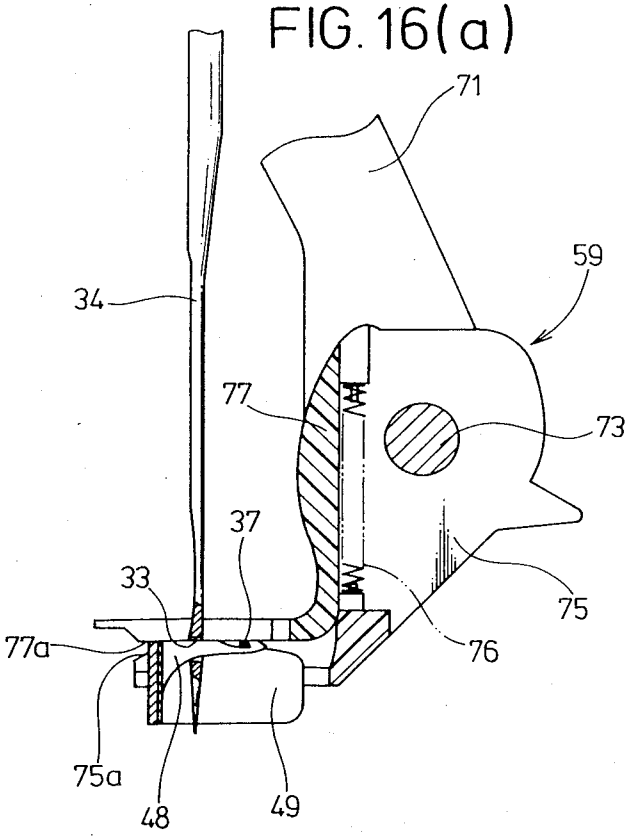

Thus, after the thread 37 has been carried near to the thread eye 33 of the needle 34 and pressed against the needle 34 by the thread holding device 59, the thread 37 is released from the thread holding device 59 in the above mentioned manner and simultaneously, the threading bar 40 is reversed to retract the threading hook 48 together with the thread 37 from the thread eye 33 to pass the thread 37 through the thread eye 33 of the needle 34 (FIGS. 11 and 16). After the threading hook 48 has been retracted, the threading device 38 is raised to the waiting position by the spring means 46. Thus, the thread 37, namely, the upper thread, is extended through the thread guide 53, the thread receiving portion 54a of the thread tension regulator 54, the take-up spring 82 provided on the guide plate 56 and the guide eye 57a of the thread take-up lever 57 and is inserted through the thread eye 33 of the needle 34. Thus, the threading operation for the preparation of the sewing machine for sewing operation is accomplished.

After the completion of a series of the threading processes, the manual pressure applied to the operating member 65 is removed to allow the extension spring 69 to raise the actuator 50 along the slot 66 formed in the left-hand surface of the arm 24 and the guide shaft 68 to the waiting position. Consequently, the actuating lever 71 carrying the thread holding device 59 and pivotally connected to the actuator 50 by the fixed shaft 70 is allowed to be raised being pivoted by the cam surface 74a of the control cam 74. Finally, the actuating lever 71 stops with the base end 71b in stable contact with the protuberant cam surface 74c as shown in FIG. 6. In this state, the thread holding device 59 projects slightly outside the arm 24 through the upper opening 63 and is seated on the upper end 28a of the support shaft 28 in a correct position, in which the fixed edges 75a and the movable edges 77a thereof are directed toward the front of the sewing machine for the next threading operation.

In this embodiment, the thread 37 is passed through the guide eye 57a of the thread take-up lever 57 before starting the threading operation, however, it is also possible to form a hook instead of the guide eye at the extremity of the thread take-up lever and to make the hook catch the thread extended during the threading operation automatically at the start of the sewing operation. Furthermore, in this embodiment, the threading hook 48 is interlocked with the operating member 65 so that the threading hook 48 will act when the operating member 65 is depressed, however, naturally, the threading hook 48 and the operating member 65 may be operated individually.

Still further, instead of the combination of the thread take-up lever 57 and the take-up spring 82 employed in the present embodiment, a device capable of the function of both the thread take-up lever 57 and the take-up spring 82, such as disclosed in U.S. Pat. No. 4,413,578, may be employed.

In this embodiment, the thread 37 supplied from the spool 61 is passed through the take-up spring 82, the thread 37 is extended near to the thread eye 33 of the needle 34 and the threading hook 48 inserted in the thread eye 33 and waiting for the threading operation is made to catch the thread 37 and to retract from the thread eye by a simple operation to depress manually the operating member 65 vertically movably provided outside the arm 24 of the sewing machine. Thus, the present invention facilitates threading of the sewing machine which usually requires troublesome work.

Since the thread carrying member 58, the thread holding device 59 and the actuator 50 for sequentially actuating the thread carrying member 58 and the thread holding device 59 operates surely, the thread 37 can be reliably extended through the take-up spring 82 to the thread eye 33 of the needle 34. Moreover, since the pivoted posture of the actuating lever 71 holding the thread holding device 59 on one end thereof is controlled according to the operating position of the operating member 65 by the control cam 74 extending along the direction of movement of the operating member 65 and engaging the other end 71a of the actuating lever 71, the actuating lever 71 may be a short member, which enables the mechanism to be formed in a simple and compact construction. Since the thread carrying member 58, the thread holding device 59 and the actuator 50 for sequentially actuating the thread carrying member 58 and the thread holding device 59 have a simple construction, the threading mechanism can be fabricated easily at a reduced manufacturing cost.

Although the invention has been described in its preferred form with a certain degree of particularity, it is to be understood by those skilled in the art that many changes and variations are possible in the invention without departing from the scope and spirit thereof.

What is claimed is:

1. A sewing machine having a main frame, an endwise reciprocable needle bar mounted in said main frame, a needle carried at the lower end of said needle bar and having a thread eye, and a threading device including a threading member operative to catch a thread led near to said thread eye and then to pass the thread through said thread eye, said sewing machine comprising:

an operating member mounted on said main frame and movable in a predetermined operating direction;

an actuating lever pivotable about a shaft perpendicular to said needle bar and adapted to move in a direction of reciprocative movement of said needle bar in association with said operating member;

a thread holding device mounted at a free end of said actuating lever and adapted to releasably hold a thread; and control cam means engageable with said actuating lever for controlling a pivoted posture of said actuating lever relative to said needle, whereby a thread may be transferred to said thread eye in association with the operation of said operating member.

2. A sewing machine according to claim 1, wherein said control cam means has a cam surface for maintaining the pivoted posture of said actuating lever constant when said thread holding device has moved to a position close to said needle.

3. A sewing machine according to claim 2, wherein said cam surface is formed to maintain the pivoted posture of said actuating lever constant while said thread holding device is located within a predetermined range on the upper and lower sides of said thread eye.

4. A sewing machine according to claim 1, further including means for operatively connecting said operating member with said threading device and said actuating lever.

5. A sewing machine having a main frame, an endwise reciprocable and laterally oscillatable needle bar mounted in said main frame, a needle carried at the lower end of said needle bar and having a thread eye, and a threading device including a threading member operative to catch a thread led near to said thread eye and then to pass the thread through said thread eye, said sewing machine comprising:

an operating member mounted on said main frame and movable in an operating direction parallel to said needle bar;

an actuating lever operatively connected with said operating member to move in said operating direction and pivotable about a shaft perpendicular to said needle bar;

a thread holding device pivotally mounted at a free end of said actuating lever and adapted to releasably hold a thread;

spring means for urging said thread holding device toward said needle to bring a thread held by said thread holding device into contact with said needle; and control cam means engageable with said actuating lever for controlling a pivoted posture of said actuating lever to said needle, whereby a thread may be transferred to said thread eye in association with the operation of said operating member.

6. A sewing machine according to claim 5, wherein said thread holding device is slidable in a direction of lateral oscillation of said needle bar on a pivot pin supported at the free end of said actuating lever.

7. A sewing machine according to claim 6, wherein said thread holding device includes a V-shaped recess engageable with said needle.

8. A sewing machine having a main frame, an endwise reciprocable needle bar mounted in said main frame, a needle carried at the lower end of said needle bar and having a thread eye, a thread take-up lever, a take-up spring disposed at an extreme end of take-up motion of said thread take-up lever, and a threading device including a threading member operative to catch a thread led near to said eye and then to pass the thread through said thread eye, said sewing machine comprising:

an operating member mounted on said main frame and movable in an operating direction parallel to said needle bar;

an actuating lever pivotable about a shaft perpendicular to said needle bar, a thread holding device mounted at a free end of said actuating lever and adapted to releasably hold a thread;

a thread carrying member for carrying a thread to said take-up spring, said thread carrying member being pivotable about a shaft perpendicular to a direction of take-up motion of said thread take-up lever; and means for operatively connecting said operating member with said actuating lever and said thread carrying member.

* * * * *